US009736589B1

(12) United States Patent
Lara

(10) Patent No.: US 9,736,589 B1
(45) Date of Patent: Aug. 15, 2017

(54) MUSIC AND HOME THEATER WIRELESS CEILING SYSTEM

(71) Applicant: Damian Lara, CD. Juarez (MX)

(72) Inventor: Damian Lara, CD. Juarez (MX)

( * ) Notice: Subject to any disclaimer, the term of this patent is extended or adjusted under 35 U.S.C. 154(b) by 0 days.

(21) Appl. No.: 15/271,397

(22) Filed: Sep. 21, 2016

(51) Int. Cl.
*H04R 5/02* (2006.01)
*H04R 1/32* (2006.01)
*H04R 1/02* (2006.01)

(52) U.S. Cl.
CPC ..... *H04R 5/02* (2013.01); *H04R 1/323* (2013.01); *H04R 1/023* (2013.01); *H04R 2201/021* (2013.01); *H04R 2420/07* (2013.01)

(58) Field of Classification Search
CPC ..... H04R 5/02
See application file for complete search history.

(56) References Cited

U.S. PATENT DOCUMENTS

2015/0260392 A1* 9/2015 Guenther ..... H04R 1/28 381/334
2017/0078778 A1* 3/2017 Chang ..... H04R 1/026

* cited by examiner

*Primary Examiner* — Olisa Anwah

(57) ABSTRACT

Music and home theater ceiling system that optionally replaces any type of equipment of music and home theater of ten channels; the system simplifies in one main ceiling unit and three peripheral devices any kind of device of this range and also allows the user to install, use and distribute a complicated system of this type and allows to change the channel loudspeaker layout in a very simple way just by rotating the main unit installed at the electrical outlet box of the lamp; the invention has a bridged wall switch that allows controlling the main unit device lights without interrupting its operation. The system receives the audio signal via Bluetooth® and decodes all channels to emit sounds and effects in different directions to immerse the listener into a three-dimensional sound during a movie or video playing.

19 Claims, 8 Drawing Sheets

MUSIC AND HOME THEATER WIRELESS CEILING SYSTEM

CROSS REFERENCE TO RELATED APPLICATIONS

The present application claims priority to the earlier filed provisional application No. U.S. 62/248,171, and hereby incorporates subject matter of the provisional application in its entirely.

BACKGROUND OF THE INVENTION

1. Field of Invention

The invention relates to the field of Home Entertainment Audio. More specifically, the invention comprises an entertainment audio system which optionally replaces any conventional type of music and home theater audio device that in a manner immerses the listener into a realistic three-dimensional sound environment related to sound effects that are played in a video or movie audio track.

2. Brief Summary of the Invention

There are many other ten channel known devices for Music and Home Theater Audio which pretend to immerse the listener into a realistic three-dimensional sound environment but all of these devices are complicated systems with many loudspeakers that must be positioned around the room, some versions require complicated placement such as in different parts of the ceiling; users of such systems find them complicated due the installation and wiring necessary. Other home theater devices are simplified by using a main unit installed under a television or under a screen where a movie or video is played, the disadvantage of these devices is the less number of channels or loudspeakers that result in the loss of three-dimensional sound effect. Other versions are installed under the television or screen where the video or movie is played and they have two wire or wireless loudspeakers that must be positioned on the rear side of the room opposite to where the movie is displayed, these two loudspeakers must be installed to enable the system to create a three-dimensional sound, giving as a result the need to distribute or to install the loudspeakers around the room to have a three-dimensional sound. Users might find complicated to change the location of the television or the video projection once an audio system is installed in accordance to the predetermined layout of the loudspeakers, relocation of video without relocation of loudspeakers affect the association of the sound and effects in specific designated locations around the room which avoid to match sounds with images displayed on screen, it concludes that every time the television or video projection change their position in a room a new loudspeakers layout installation is needed. Related documents to the invention: Provisional patent application No. 61/749,789, Provisional patent application No. 61/835,466, Provisional patent application 61/914,854, PCT/US2014/010466, US Patent Application 20150189439.

The home theater and audio system which for this application is presented, optionally replaces any type of music and home theater audio device up to nine loudspeakers and two subwoofers divided by ten channels. This system simplifies in one main ceiling unit and three peripheral devices any kind of device of this range and also allows the user to install, use and distribute a complicated system of this type in a very simple way and to change the loudspeaker layout just by rotating the main unit.

Details of the pieces and characteristics of the device are shown and described in detail in the provided drawings and description.

DETAILED DESCRIPTION OF THE INVENTION

Figure 7:
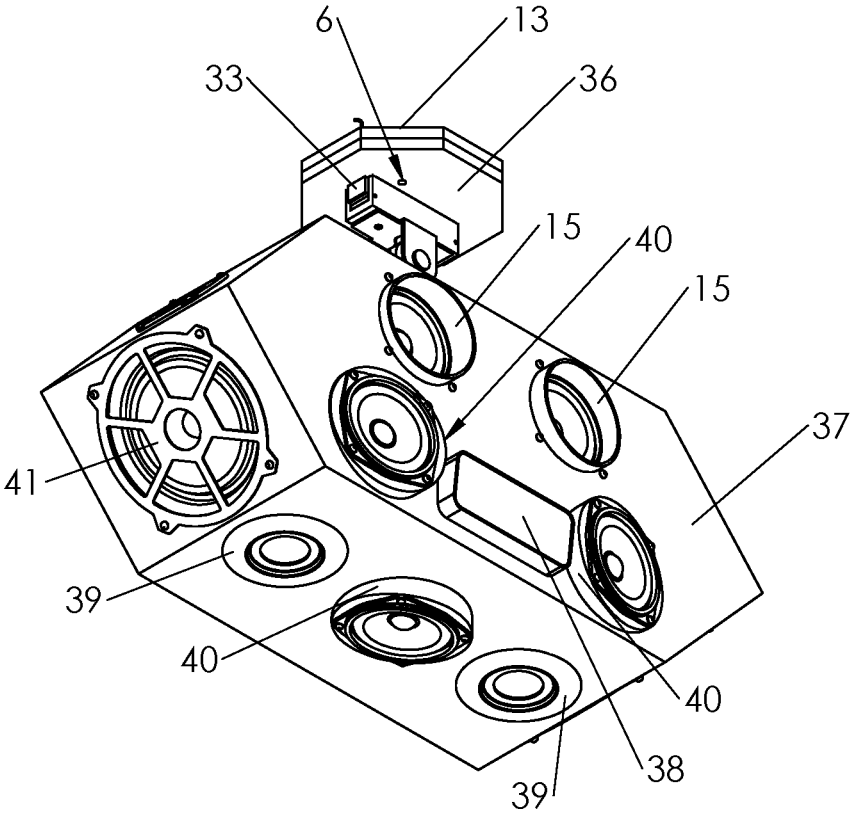
FIG. 7 is a perspective frontal view of the complete main unit with the multidirectional mounting bracket and outlet base face to face assembled.

The description refers to the invention of an audio system for music and home theater which has a main unit designed to be mounted on the ceiling and which can be used for music playback or to play an audio track of a video using as an audio source a smart phone, tablet, computer, television or any device that supports Bluetooth®, WI-FI® or is equipped with optical audio port, the invention also can be used to play an audio track from a movie while is projected in a home theater video projector. For purposes of description, the following terms have the associated meanings: "driver" means single electro-acoustic transducer that produces sound in response to an electrical audio input signal, "channel" is an audio signal plus metadata in which the position is coded as a channel identifier to set the pre-defined set of loudspeaker zones with associated locations, "sound effect" refers to a recorded real or synthesized sound related with an audio track of a video which can be associated in accordance with the images projected of a video and which can be mixed with music and other ambience sounds, "Three-dimensional sound effect" sound effects which can be listened inside a room at different locations and not as they are coming from a single specific location in a three-dimensional space like a room. The invention has a main unit device FIG. 7 and three peripheral additional wireless devices which are necessary for its operation which are described as audible wireless subwoofer unit FIG. 9, audible and inaudible wireless subwoofer unit FIG. 10 and a bridged wall switch FIG. 8. The main unit FIG. 7 refers to a device designed to be installed on the ceiling where usually an electrical outlet box is found and supplies energy for a lamp in a house, business or any roofed area, this device is equipped with wireless receivers, Bluetooth® and WI-FI® to receive a wireless audio signal from any compatible player device to be decoded and played through the different channels assigned to the different loudspeakers drivers; simultaneously the main unit retransmits the signal for the bass through a wireless transmitter to make these sounds can be played back through the two wireless receiver subwoofers units located on the floor. The main unit is equipped with nine loudspeaker drivers which emit separated sounds by channels at different angles to emulate the ambience of a three-dimensional sound which is used in the different soundtracks of audio formats for films in the known versions of Dolby or DTS 2.1, 5.1, 7.1, Dolby Atmos® 9.1, 9.2 and DTS:X. The invention main unit has nine loudspeakers which are aimed at different locations which allow the sound to be listened in three dimensions regardless if the listener is in an open area, this is accomplished thru loudspeaker angles that cover around, below and upper areas and by emitting the sound from the center of the area where the invention system is installed, if the main unit is in a room the loudspeakers reflect the sound aimed to the ceiling and to the walls which allow the loudspeakers to produce the effect of surround sound in three dimensions.

The invention described has a main unit which is equipped with nine loudspeakers aimed to different locations in the room and include two floor subwoofers used to emit bass, all these loudspeaker channels are separated and are designed to work and to be listened while the audience is seated in front of the video which is displayed at the time the system is operating, the loudspeaker drivers emit the sound effects in accordance with the setup as described in the following layout: center loudspeaker (29), located at the center of the bottom of the main unit placed to emit sounds that come in appearance related with sounds situated in the center of the screen, front left loudspeaker (27), located at the left side at the bottom of the main unit placed to emit sounds that come in appearance related with sounds situated in the left side of the screen, front right loudspeaker (31), located at the right side at the bottom of the main unit placed to emit sounds that come in appearance related with sounds situated in the right side of the screen, left surround loudspeaker (26), located at the bottom in the front in the left side of the main unit placed to emit sounds that are perceived on the left side of the room, right surround loudspeaker (25), located at bottom of the front in the right side of the main unit placed to emit sounds that are perceived in the right side of the room. In the frontal panel of the main unit it has a left loudspeaker (23) and a right loudspeaker (24) these driver loudspeakers are integrated to be part of the audio angle dispersion reducers described in FIG. 3A and FIG. 3B both are characterized by a front ring tube around each one of the drivers, they are muted at their rear part by a tube (17) and a foam (19) to avoid that the sound that they emit at their back produce a sound resonant effect inside the acoustic box of the main unit, these audio driver angle dispersion reducers are designed to avoid the listener to perceive the audio coming from the main unit; the audio angle dispersion reducers have the characteristic of emitting a narrow audio beam with more sound intensity which direct the audio beam against the rear wall to be reflected, one of these drivers is defined as left rear loudspeaker (23) located in the front at the left side at the top of the main unit placed to emit sounds that are perceived in the left rear part of the room, the other driver is defined as right rear loudspeaker (24) located in the front at the right at the top of the main unit placed to emit sounds that are perceived in the rear right part of the room.

The main unit has on its upper angled sides two opposite loudspeaker drivers aimed to the ceiling and they are defined as overhead loudspeakers; the left overhead loudspeaker (20) is located on the left side at the top of the main unit placed to emit sounds that are perceived in the left side of the ceiling of the room and it is separated from the other loudspeaker driver by an audio channel to work as the overhead right loudspeaker (22), located on the right side at the top of the main unit placed to emit sounds that are perceived in the right side of the ceiling of the room. For bass channels the main unit transmits simultaneously in real time the bass wireless signals for both subwoofers located on the floor which can be electrical powered and situated in any place in the area; the audible subwoofer unit FIG. 9 emit bass sounds that can be perceived in an audible way from anywhere in the room without specific direction and the audible and inaudible subwoofer unit FIG. 10 will emit bass sounds that may be perceived by the hearing sense and through the sense of touch from anywhere in the room without a specific direction. The main unit has a spotlight on the bottom of the left (28) and a spotlight on the bottom of the right (30) both are controlled wirelessly through the bridged wall switch FIG. 8 which has as a main function to turn on and turn off the lights without interrupting electrical power supplied to the main unit, this bridged wall switch has an independent switch (47) that is used to cut the power and to be able to reset the system; the spotlights found in the main unit are equipped to replace the need of lighting that is subtracted by utilizing the position of the lamp of the room where the outlet base described in FIGS. 1A and 1B must be attached with a pair of screws, this outlet base is used to support the total weight of the main unit FIG. 7 and to provide it with electrical power, the multidirectional mounting bracket FIG. 2A is designed to insert its plugs (10) and support latches (8) into the outlet base to fit together and firmly attach the main unit to the ceiling; the multidirectional mounting bracket has an adjustable mechanism (11) to level the main unit in any position to allow the user to fix the slope or inclination of the ceiling; the multidirectional mounting bracket also has a rotor (12) that enables to position the main unit at any direction to set the loudspeaker drivers as required and in reference to the place in which the video or movie is displayed in a room.

Figure 1A:
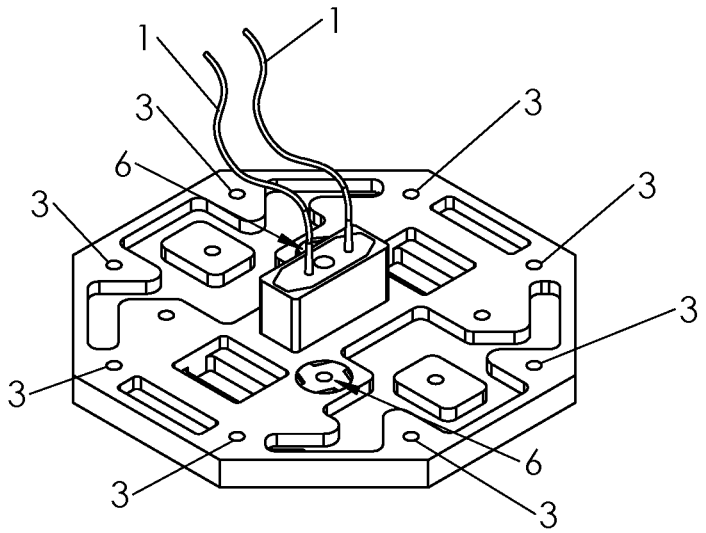
FIG. 1A is a perspective view of the back of the outlet base that is used to place and anchor the main unit to the ceiling to support and to feed the main unit with electrical energy.
Figure 1B:
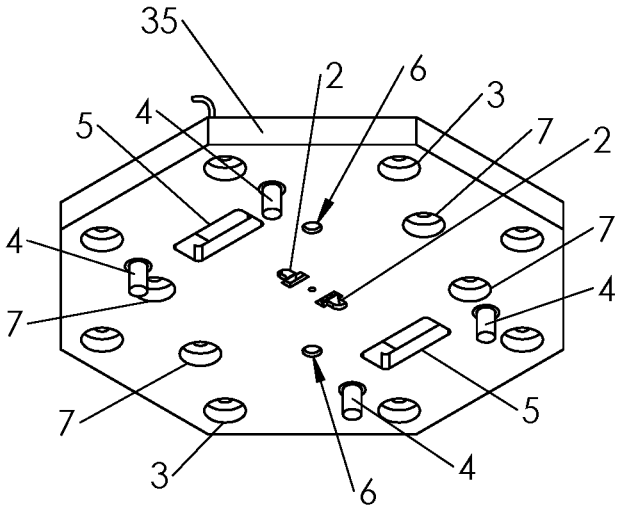
FIG. 1B is a perspective face view of the outlet base that is used to place and anchor the main unit to the ceiling to support and to feed the main unit with electrical energy at the lamp outlet box.
Figure 2A:
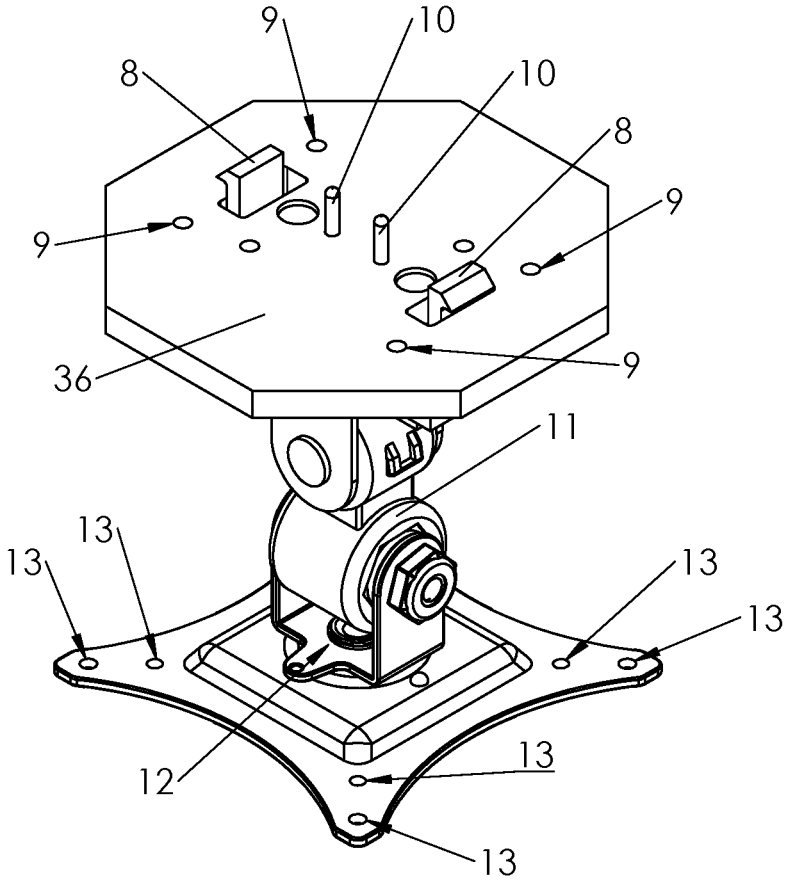
FIG. 2A is a perspective view of the multidirectional mounting bracket which provide support to the main unit and which provides electrical energy through the alternate currency plugs which connect to the outlet base.

Specifically the outlet base described in FIG. 1A and FIG. 1B is used to place and anchor the main unit to the ceiling and to provide it with electrical energy; it has four holes (7) near the center of the outlet plate (35) and eight holes (3) for each one of the eight vertexes to be able to be mounted in any kind of a standard electrical outlet box, It is equipped with four torque pins (4) to avoid the latches (8) of the multidirectional mounting bracket FIG. 2A to receive the torque force when the main unit is rotated to be aimed in the position is needed. The outlet base has two slots (5) to be assembled with the latches of the multidirectional mounting bracket and has two threaded inserts (6) to place a secure bolts to avoid the main unit to fall in an unusual event. The outlet base is provided with a pair of cables (1) to be connected to the outlet electrical box of the lamp and which are connected to the female electrical contacts (2) designed to be inserted by the male plugs (10) of the multidirectional mounting bracket which provides electrical power for the main unit of the invention when the audio system is installed. The multidirectional mounting bracket has two latches (8) to support the main unit and it has four holes (9) in the mounting bracket plate (36) to assemble with the torque pins (4) of the outlet base at the moment of the mounting bracket is face to face with the outlet plate. The multidirectional mounting bracket also has an adjustable mechanism (11) to level the main unit in order to be horizontal by not depending of the ceiling inclination; it has one rotor (12) to rotate the main unit and it also has eight holes (13) to be screwed to the top of the main unit. The multidirectional mounting bracket is equipped with two release buttons (33) at the upper part of the mounting bracket and they are designed to be used for a quick install and uninstall of the main unit by just the press of the buttons.

The main unit is built in a manner that the housing works as an acoustic box (37), equipped with left and right loudspeakers grill protectors (41) attached to the acoustic box that houses the main electronic boards and accessories assembled inside. At the top of the acoustic box it has an audio input optical cable port (21) and has at the bottom the left and right socket bases (39) for spotlights. The acoustic box supports a set of angled wedges (40) one for the left surround loudspeaker (26) one for the right surround loudspeaker (25) and one more for the center loudspeaker (29) which are used to angle the loudspeaker drivers to be aimed toward the location needed; the acoustic box also has a main command display (38) attached in the front panel to be used as a monitor of commands.

Figure 3A:
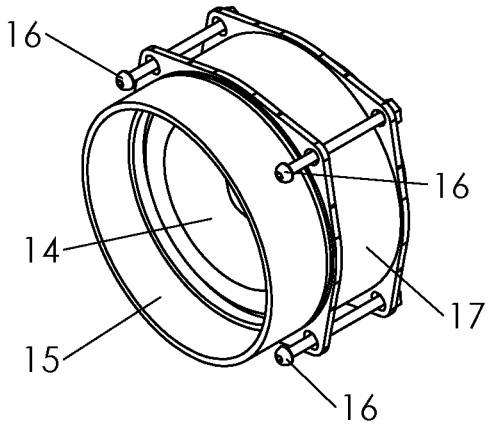
FIG. 3A is a perspective front view of an audio driver dispersion reducer unit.
Figure 3B:
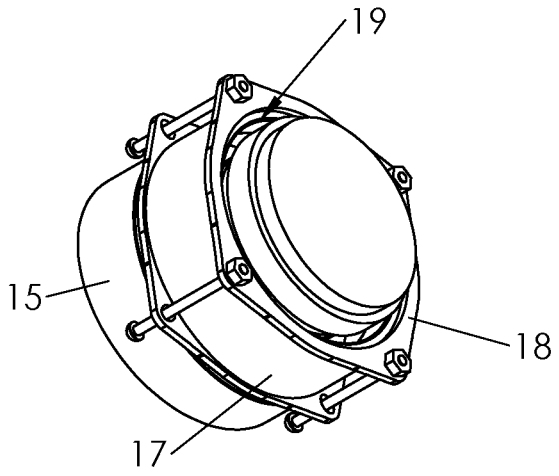
FIG. 3B is a perspective rear view of an audio driver dispersion reducer unit.
Figure 4:
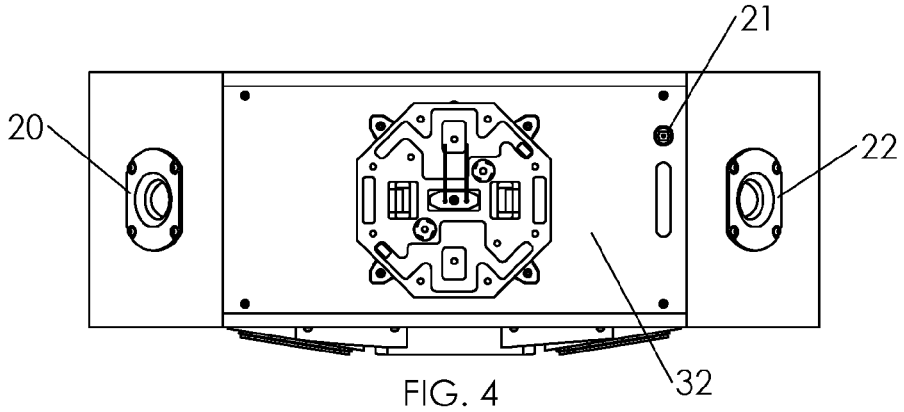
FIG. 4 it is the top view of the main unit.
Figure 5:
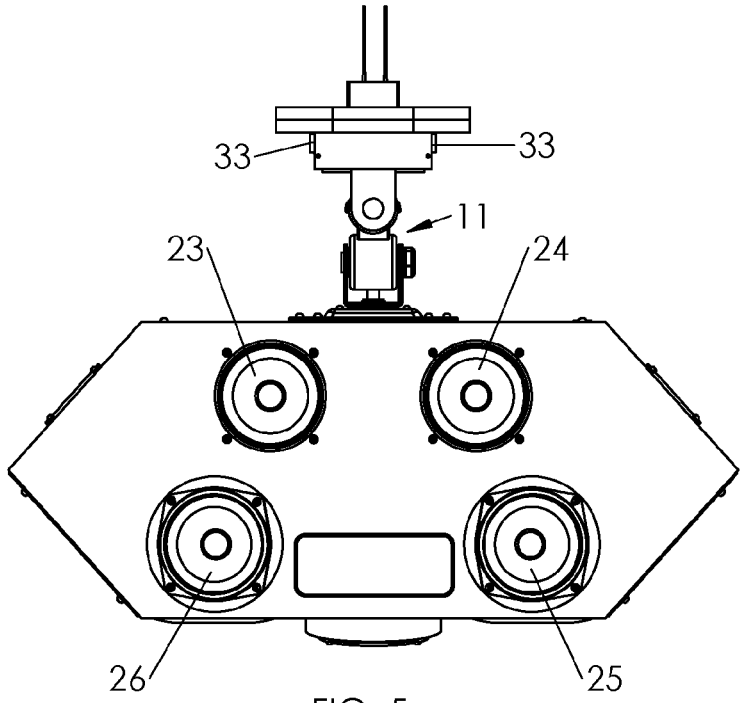
FIG. 5 it is the front view of the main unit.
Figure 6:
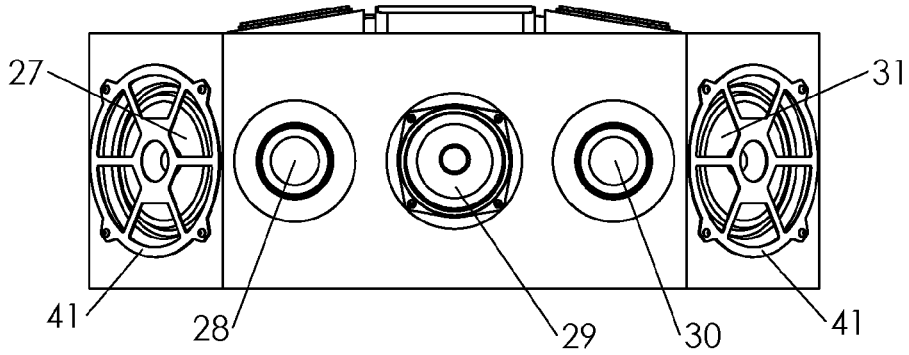
FIG. 6 it is the bottom view of the main unit.

In the front panel in the upper part of the acoustic box one can find the right and left audio dispersion reducer units described in FIG. 3A and FIG. 3B, each one has a tube ring (15) that is used to reduce the audio dispersion of the loudspeaker cone (14), each one of this audio dispersion units are tighten by four bolt oppressors (16) that maintain the back tube (17) and muted foam (19) together by compressing the back holed plate (18) against the front panel of the acoustic box; these audio reducer units are designed to give each of the loudspeakers drivers the ability to enhance the sound distance with a narrow audio beam, the back tube and muted foam is designed to suppress the local audio resonance inside the acoustic box to avoid the listener perceive the local sound as coming from the central area where the main unit is situated at the moment is operating.

The main unit has two channel for overhead loudspeakers, one is on the left (20) and one is on the right (22) both are located on the left and right angled top of the main unit to emit sounds that can be reflected on the ceiling so the listener can perceive sounds and effects from the video or movie audio track on the left and right overhead area of the ceiling by separated channels.

Figure 8:
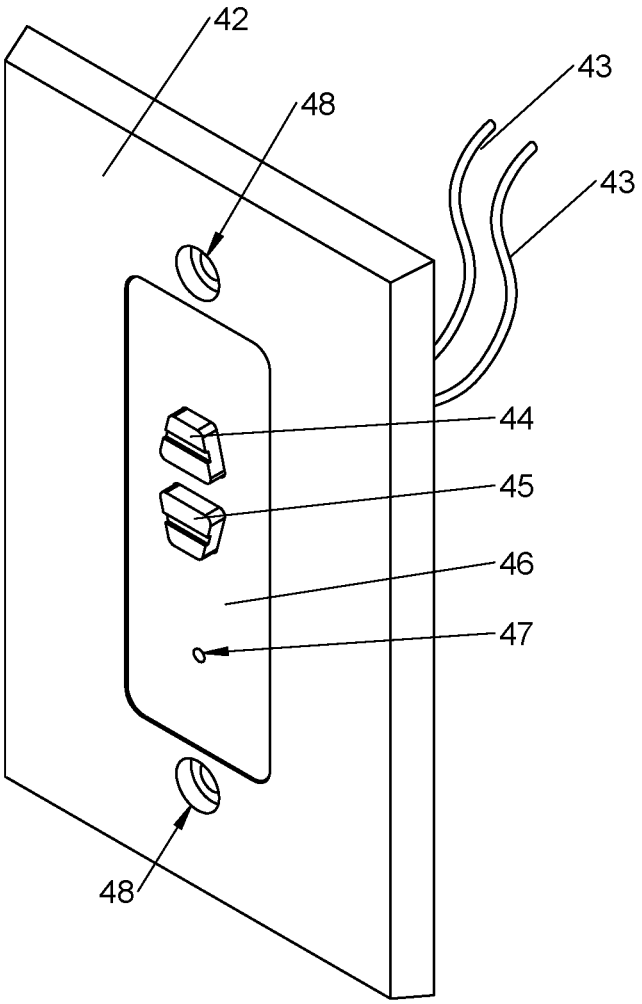
FIG. 8 is a perspective view of the bridged wall switch with its wireless lighting switch buttons.

The invention described has a main unit and three peripheral devices that are necessary for its functionality, it has a wall bridged switch FIG. 8 that is used to control the spotlights of the main unit without interrupting the electricity that feeds the main unit while it is working; this wall switch has a plate (42) used to be attached to the electricity outlet box through its screw holes (48); the wall bridged switch has two bridged cables (43) used to be connected to the electricity outlet box of the lamp switch where the invention audio system is installed, this bridged cables are connected to an independent mini switch (47) used to restart the system by momentarily cutting the electricity when pressed through a thin object that can be introduced to the small hole of the front panel (46); the wall bridged switch has a turn on button (44) and a turn off button (45) that control the spotlights of the main unit through a wireless transmission signal.

Figure 9:
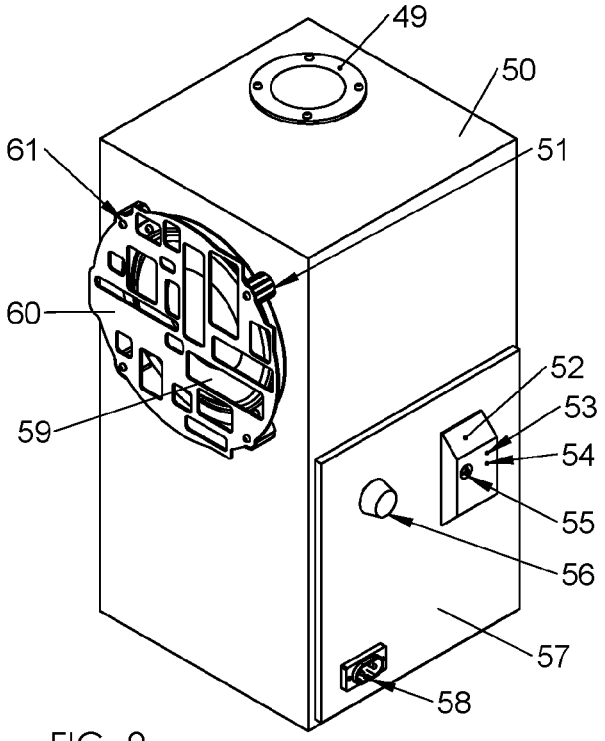
FIG. 9 is a perspective rear view of the complete audible subwoofer unit with enclosure, port, amplifier and woofer protection grill.
Figure 10:
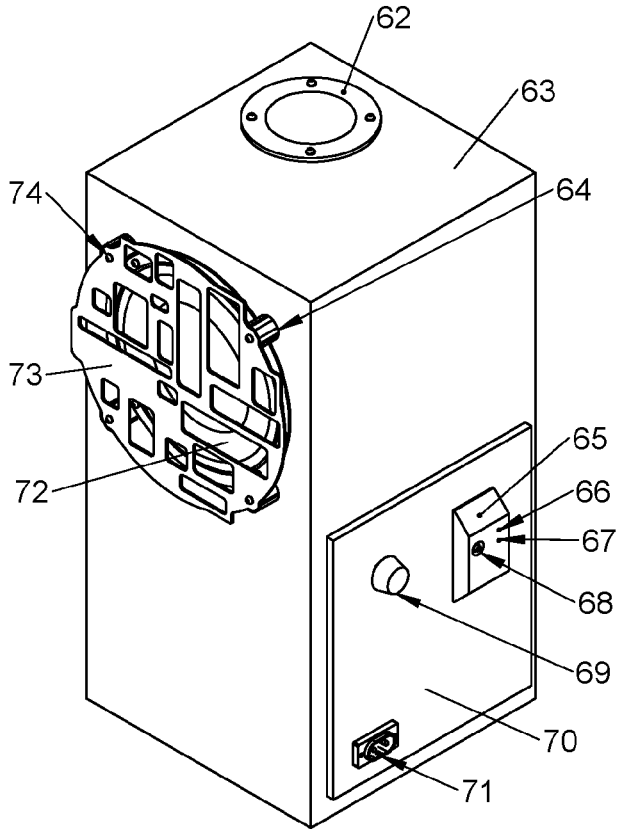
FIG. 10 is a perspective rear view of the complete audible and sub-audible subwoofer unit with enclosure, port, amplifier and woofer protection grill.

The main unit of the invention have two other devices needed for its operation, they are described as an audible subwoofer unit FIG. 9 and audible and sub-audible subwoofer unit FIG. 10 both have similar characteristics but different specifications; the first one described as an audible subwoofer unit FIG. 9 have a woofer driver (59) used to emit audible low frequencies that can be listened from any place of the room or area without a specific direction, this loudspeaker woofer is attached to the acoustic box (50) with four bolts (61) that are used as oppressors to support the protection grill (60) separated with four spacers (51) that allow having enough space between the loudspeaker woofer and protection grill to avoid hitting and damaging the cone during its operation; the subwoofer unit is designed with a vented enclosure and has port tube (49) situated at the top of the acoustic box that allows emitting sound that can be perceived with a not specific direction in the room. At the rear part of the subwoofer unit acoustic box (50) it has a plate amplifier (57) that can be connected to the electricity through the AC connector (58); the plate amplifier has a wireless receiver (52) to receive the signal for the low frequencies that are transmitted from the main unit; this wireless receiver has an ON indicator light (53), a wireless connection indicator light (54), a pairing reset button (55) to reestablish wireless connection and an audio volume knob (56) to control the bass volume intensity.

The third device that the main unit of the invention needs for its operation is the audible and sub-audible subwoofer unit FIG. 10 this subwoofer unit has a driver woofer (72) that is used to emit audible bass and low frequencies that can be listened and felt from any place of the room or area without a specific direction, this sub-woofer loudspeaker is attached to the acoustic box (63) with four bolts (74) that are used as oppressors to support the protection grill (73) separated with four spacers (64) that allow to have enough space between the loudspeaker sub-woofer and protection grill to avoid to hit and damage the cone during its operation; the subwoofer unit is designed with a vented enclosure and has port tube (62) situated at the top of the acoustic box that allows emitting sound and vibration that can be perceived with a not specific direction in the room. At the rear part of the subwoofer unit acoustic box it has a plate amplifier (70) that can be connected to the electricity through the AC connector (71); the plate amplifier has a wireless receiver (65) to receive the signal for the low frequencies that are transmitted from the main unit; this wireless receiver has an ON indicator light (66), a wireless connection indicator light (67), a pairing reset button (68) to reestablish wireless connection and an audio volume knob (69) to control the bass volume intensity.

Figure 11:
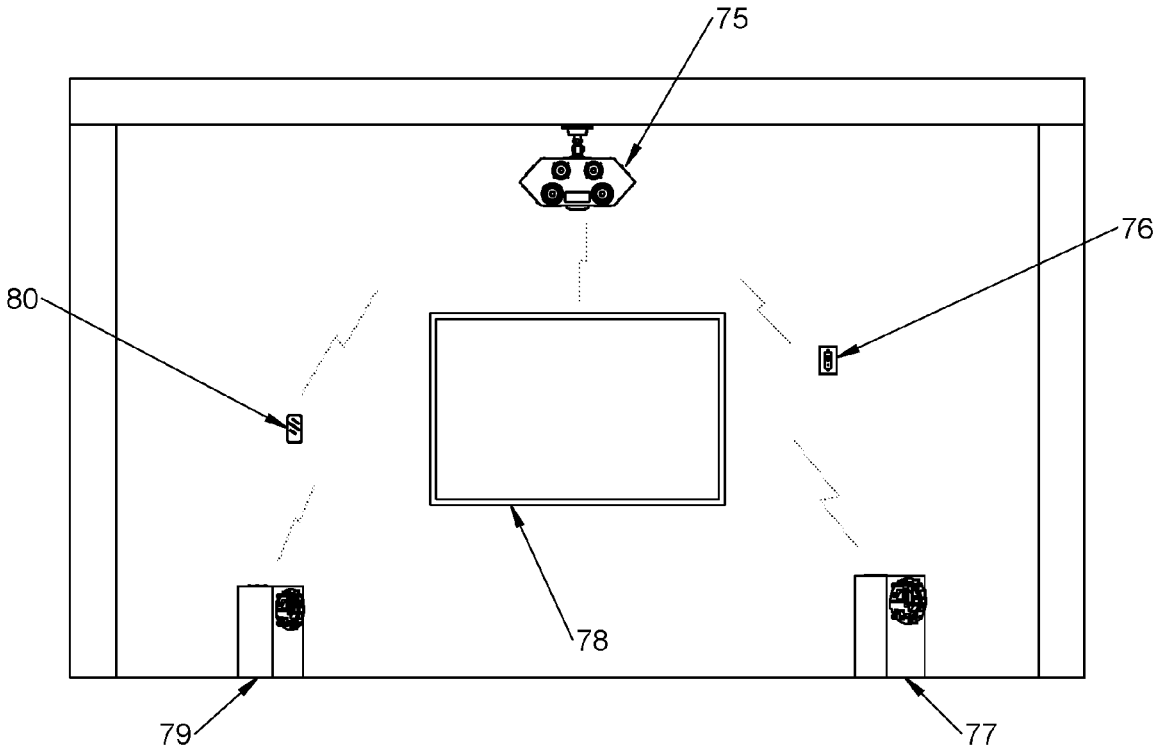
FIG. 11 is a front view of a room with the complete invention and its peripherals installed with a demonstrative television and smart phone.

Once the invention main unit is installed with all its peripheral devices inside a room as shown on FIG. 11 allows the main unit (75) situated on the central part of the ceiling be assisted through the audible subwoofer unit (79) and through the audible and sub-audible subwoofer unit (77) which are located on the floor and which allow the main unit to emulate the center channel sounds like they are coming from the television (78) and not being perceived as they are coming from the upper area where the main unit is placed, all the rest of the drivers will produce a three-dimensional immerse sound in accordance with designated channels for the different locations around the room; the bridged wall switch (76) must be located at the electrical outlet box where the room lights interrupter is located to allow to turn on and to turn off the spotlights of the main unit without interrupting the power electricity that provides energy for its operation. All the functions of the invention that control all the parameters will be controlled by a universal control or smart phone (80) which allows controlling the upper main unit and its peripherals from any place in the room.

I claim:

1. Music and home theater ceiling system that simplifies the installation of systems of ten channels, comprising: a music and home theater invention with a main unit that can be mounted in the ceiling and powered through the electrical power provided by any covered area at the outlet electrical box replacing the bulb or lamp located in a room, once mounted the main unit of the invention wirelessly receives the audio signal via Bluetooth®, WI-FI® or an optical audio cable from any compatible device in order to decode the audio signal from a video soundtrack to distribute the sounds by nine separated channels divided in nine directions where the loudspeaker drivers are aimed to develop separated sound effects that overlap to produce a three dimensional sound;

the main unit device retransmits wirelessly the tenth channel for the bass and low frequencies for the two floor subwoofer units which emit bass and low frequencies that can be perceived in any area without specific direction; the main unit of the invention has a quick release outlet base and a multidirectional mounting bracket for an easy installation and removal, this multidirectional mounting bracket allows the main unit device to be leveled in any position to compensate the inclination of the ceiling and it has a rotor that allows to have a rotary motion to enable the main unit to be aimed in any direction to allow the loudspeakers drivers to emit the sounds in any direction needed by taking as a reference the place in which the video in a room is being played;

the main unit device has two spotlights to illuminate and replace the need of lighting that is subtracted at the moment is installed in the place of the lamp in a room and has the capability that the lights can be controlled wirelessly with the bridged wall switch which is mounted on the wall at the electrical outlet box of the lamp just in the room where the invention system is installed; the switch enables the main unit to operate without interrupting its operation at the moment of turning on or turning off the lights.

2. The music and home theater ceiling system according to claim 1, wherein the main unit uses the same acoustic box for nine loudspeaker drivers to emit sounds in nine different directions divided by channels to create the effect that the sounds are coming from the place of each one of the loudspeakers drivers are aimed.

3. The music and home theater ceiling system according to claim 1, wherein the outlet base has twelve holes to screw in any type of ceiling electrical outlet box by using two screws that anchor the base to the outlet box in any direction needed.

4. The music and home theater ceiling system according to claim 1, wherein the outlet base has two rectangular slots that assemble with the multidirectional mounting bracket through the latches that hold the main unit.

5. The music and home theater ceiling system according to claim 1, wherein the multidirectional mounting bracket has two latches that fit by spring pressure into the rectangular slots of the outlet base to avoid the latches to lose.

6. The music and home theater ceiling system according to claim 1, wherein the multidirectional mounting bracket has two electrical contacts that are used as a plug to be inserted into the outlet base to provide electrical power to the main unit.

7. The music and home theater ceiling system according to claim 1, wherein the multidirectional mounting bracket has a mechanism of two-axis able to position the main unit in any position in order to compensate the unevenness of the ceiling where is installed.

8. The music and home theater ceiling system according to claim 1, wherein the multidirectional mounting bracket can rotate the main unit 360 degrees to change the layout of the loudspeaker drivers without the need of making a new installation in order to emit sounds and effects that match with the images displayed on the screen when the video location is changed.

9. The music and home theater ceiling system according to claim 1, further comprises an audio dispersion reducer unit that has a frontal ring tube that is designed to reduce the audio dispersion angle of the loudspeaker cone and to enhance the audio intensity to emit a narrow audio beam that can be reflected against the rear wall.

10. The music and home theater ceiling system according to claim 9, wherein the audio dispersion reducer unit further comprises a rear ring tube with sponge which reduces the resonance effect of the loudspeaker driver in order to mute the sound inside the acoustic box of the main unit to avoid the listener to perceive the rear sound effects as coming from the central area.

11. The music and home theater ceiling system according to claim 1, wherein the same main unit acoustic box is used as housing to support nine loudspeakers.

12. The music and home theater ceiling system according to claim 1, wherein the main unit acoustic box is used as housing to support in its bottom two lights that provide illumination of the area where the main unit is installed.

13. The music and home theater ceiling system according to claim 1, wherein the main unit acoustic box is used as a housing to contain and attach electronic boards inside.

14. The music and home theater ceiling system according to claim 1, further comprises three wedges to angle the center loudspeaker, the left surround loudspeaker and the right surround loudspeaker to be aimed in different directions.

15. The music and home theater ceiling system according to claim 1, wherein the wall bridged switch controls the lights wirelessly letting electrical current pass with no interruption so the main unit do not turn off at any time during its operation.

16. The music and home theater ceiling system according to claim 15, wherein the wall bridged switch further comprises an independent momentary switch to restart the general system to the default values by cutting the power.

17. The music and home theater ceiling system according to claim 1, wherein the two subwoofer units have audio ports at the left of the top to emit audio toward the ceiling to produce bass audio dispersion.

18. The music and home theater ceiling system according to claim 17, wherein the subwoofer units have a woofer loudspeaker protection grill with perforated square design to allow the emission of the sound.

19. The music and home theater ceiling system according to claim 1, wherein the two subwoofer units with acoustic enclosures boxes and audio resonance port tubes are designed to resonate together in low frequencies that can emit sounds and frequencies that can be perceived in an audible way and by the sense of touch without a specific direction and from anywhere in the room.

* * * * *